US005159355A

United States Patent [19]

Horio et al.

[11] Patent Number: 5,159,355

[45] Date of Patent: Oct. 27, 1992

[54] INK JET APPARATUS WITH VOLTAGE CONTROL UNIT CONTROLLING A VOLTAGE SOURCE TO APPLY AC PREHEATING VOLTAGE AND DC INK-BOILING VOLTAGE

[75] Inventors: Hideaki Horio; Hiroaki Sakai, both of Fukuoka; Masaharu Oyama, Chikushino; Mituhide Matuda, Fukuoka, all of Japan

[73] Assignee: Matsushita Electric Industrial Co., Ltd., Osaka, Japan

[21] Appl. No.: 623,530

[22] Filed: Dec. 7, 1990

[30] Foreign Application Priority Data

Dec. 13, 1989 [JP] Japan ..... 1-323354

[51] Int. Cl.[5] ..... B41V 2/05

[52] U.S. Cl. ..... 346/140 R

[58] Field of Search ..... 346/140

[56] References Cited

U.S. PATENT DOCUMENTS

| | | | |
|---|---|---|---|
| 3,179,042 | 4/1965 | Naiman | 346/140 X |
| 4,275,290 | 6/1981 | Cielo | 346/140 X |
| 4,595,937 | 6/1986 | Conta | 346/140 |
| 4,712,172 | 12/1987 | Kiyohara | 346/140 X |

FOREIGN PATENT DOCUMENTS 61-122840 8/1986 Japan .

*Primary Examiner*—Joseph W. Hartary

*Attorney, Agent, or Firm*—Stevens, Davis, Miller & Mosher

[57] ABSTRACT

An ink jet apparatus includes a pair of electrodes disposed on an inner wall of an ink reservoir that is provided with a nozzle. An AC voltage is applied to the electrodes to preheat the conductive ink and prevent electrolysis of the conductive ink. A DC voltage is applied to the electrodes after the ink has been preheated to evaporate the conductive ink so that the increase in ink volume jets the conductive ink from the nozzle. The AC voltage is applied within a frequency range especially effective to suppress electrolysis of the conductive ink.

4 Claims, 7 Drawing Sheets

INK JET APPARATUS WITH VOLTAGE CONTROL UNIT CONTROLLING A VOLTAGE SOURCE TO APPLY AC PREHEATING VOLTAGE AND DC INK-BOILING VOLTAGE

BACKGROUND OF THE INVENTION

1. Field of the Invention

The present invention relates to an ink jet apparatus utilizing volume expansion caused by evaporation heated of ink.

2. Description of the Related Art

Recently, a printer using an ink jet apparatus is widely utilized as an output printer for an office computer because of its silent printing operation.

A conventional ink jet apparatus is described hereinafter.

FIG. 6 schematically illustrates a conventional ink jet printer. In FIG. 6, numeral 1 denotes an ink reservoir for storing electrical conductive ink, 2 an ink tank for supplying the conductive ink to the ink reservoir 1, and 3 a nozzle having an opening formed in part of a wall forming the ink reservoir 1. Numerals 4 and 5 denote a pair of electrodes fixedly mounted on part of the wall forming the ink reservoir 1, and 6 a power supply connected to the electrodes 4 and 5.

Operation of the ink jet apparatus having the above structure is described hereinafter.

When a voltage of the power supply 6 is applied between the electrodes 4 and 5, a current flows through the conductive ink between the electrodes 4 and 5. The conductive ink between the electrode 4 and 5 is heated and partially evaporated to produce bubbles, so that volume of the ink expands sharply and the conductive ink within the reservoir is pressurized. The conductive ink is jetted or spouted out from the nozzle 3 by the pressure thereof. When the application of the voltage from the power supply 6 is stopped, the bubbles produced in the conductive ink disappear rapidly since an amount of heat of the bubbles is taken by the conductive ink around the bubbles, so that pressure within the ink reservoir becomes negative and the ink jet stops.

With the conventional structure described above, however, when a DC power supply is used as the power supply, the direction of current flowing between the electrodes is fixed and the conductive ink is electrolyzed at the electrodes, so that deposits are formed at the electrodes and the electrodes are deteriorated. Accordingly, the shape of the electrodes can not be kept uniform. Further, when an AC power supply is used as the power supply, the electrolysis between the electrodes can be prevented. However, since an instantaneous value of AC signal is always varied as shown by (a) of FIG. 7, a temperature Te of the ink is varied unevenly as shown by (b) of FIG. 7 in synchronism with the absolute value of the current I flowing between the electrodes by the AC power supply. Since an amount of heat for heating the conductive ink is larger than an amount of heat absorbed into the surrounding conductive ink when the instantaneous current is large, the temperature of the ink is increased. However, when the instantaneous current is small, an absorption rate of the heat into the surrounding conductive ink is higher than a rate of heating the conductive ink. Accordingly, even if the temperature Te of the conductive ink becomes higher than a jet temperature Fu and the ink jet starts at time A, since an ink temperature Te varies around the jet temperature Fu due to variation of the instantaneous value of current, the ink is jetted or spouted out with small drops of particles many times. Accordingly, the ink is flown about or scattered and a stable ink jet cannot be obtained.

SUMMARY OF THE INVENTION

It is an object of the present invention to provide an ink jet apparatus which can prevent electrolysis of conductive ink.

According to the present invention, the ink jet apparatus including a pair of electrodes disposed on an inner wall of an ink reservoir provided with a nozzle and storing conductive ink therein and in which a voltage is applied to the pair of electrodes to evaporate the conductive ink so that bubbles are produced to jet the conductive ink from the nozzle, includes means for controlling an applied voltage to the pair of electrodes so that a voltage for preheating the conductive ink is applied first and then a voltage sufficient to boil the conductive ink is applied to evaporate the conductive ink which is preheated.

DESCRIPTION OF THE PREFERRED EMBODIMENT

Figure 1:
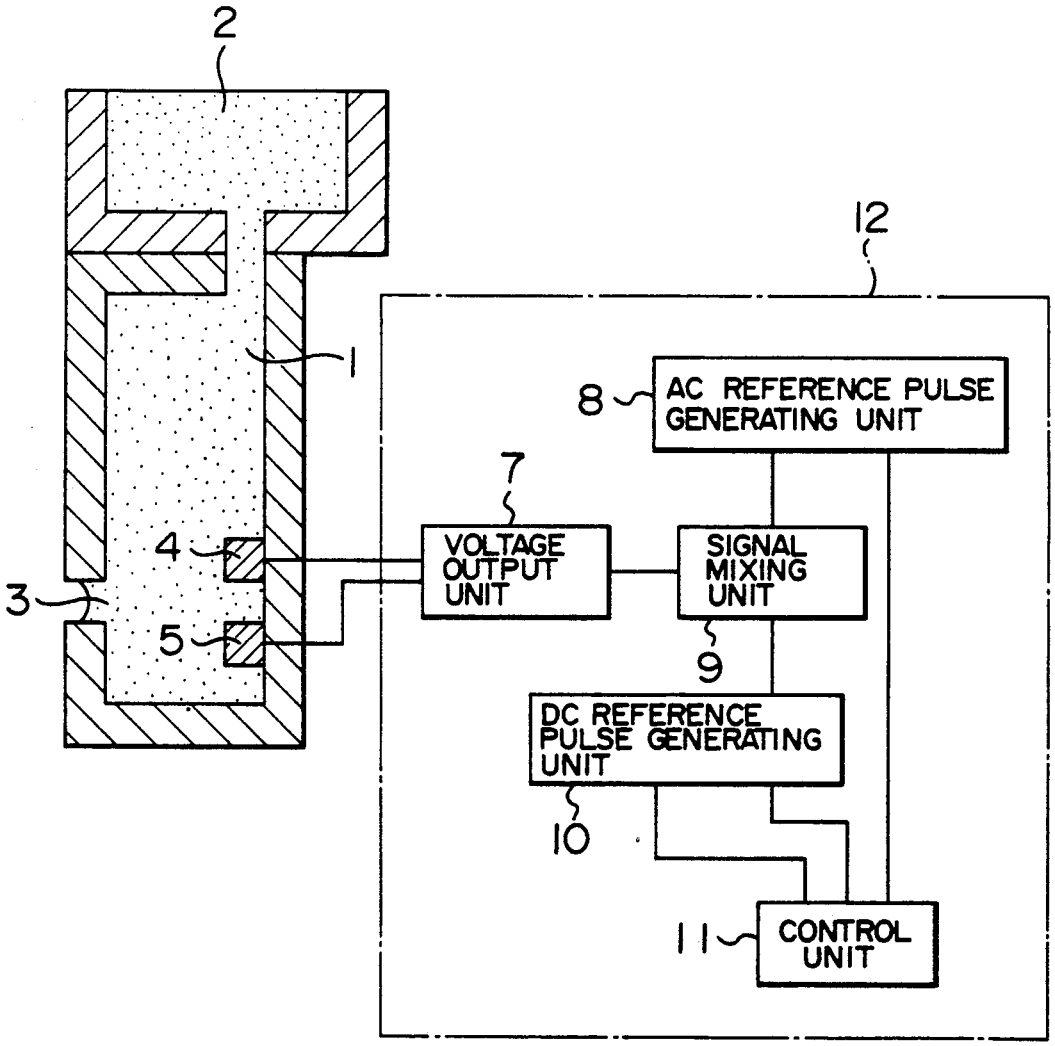
FIG. 1 schematically illustrates an ink jet apparatus according to an embodiment of the present invention.

FIG. 1 schematically illustrates an ink jet apparatus according to an embodiment of the present invention.

In FIG. 1, numeral 1 denotes an ink reservoir, 2 an ink tank, 3 a nozzle, and 4 and 5 electrodes. The functions these elements are the same as those of the conventional ink jet apparatus. Numeral 12 denotes a voltage controller, 11 a control unit for controlling a frequency of a voltage applied between the electrodes 4 and 5 and a time of applying the voltage therebetween, 8 an AC reference pulse generating unit for forming pulses which determine a positive voltage portion and a negative voltage portion from an AC signal supplied from the control unit 11, 10 a DC reference pulse generating unit for determining the sign of a DC signal of the control unit 11 whether it is positive or negative, 9 a signal mixing unit for mixing an AC reference pulse and a DC reference pulse, and 7 a voltage output unit for applying a voltage between the electrodes 4 and 5 in synchronism with an output of the signal mixing unit 9.

Figure 2:
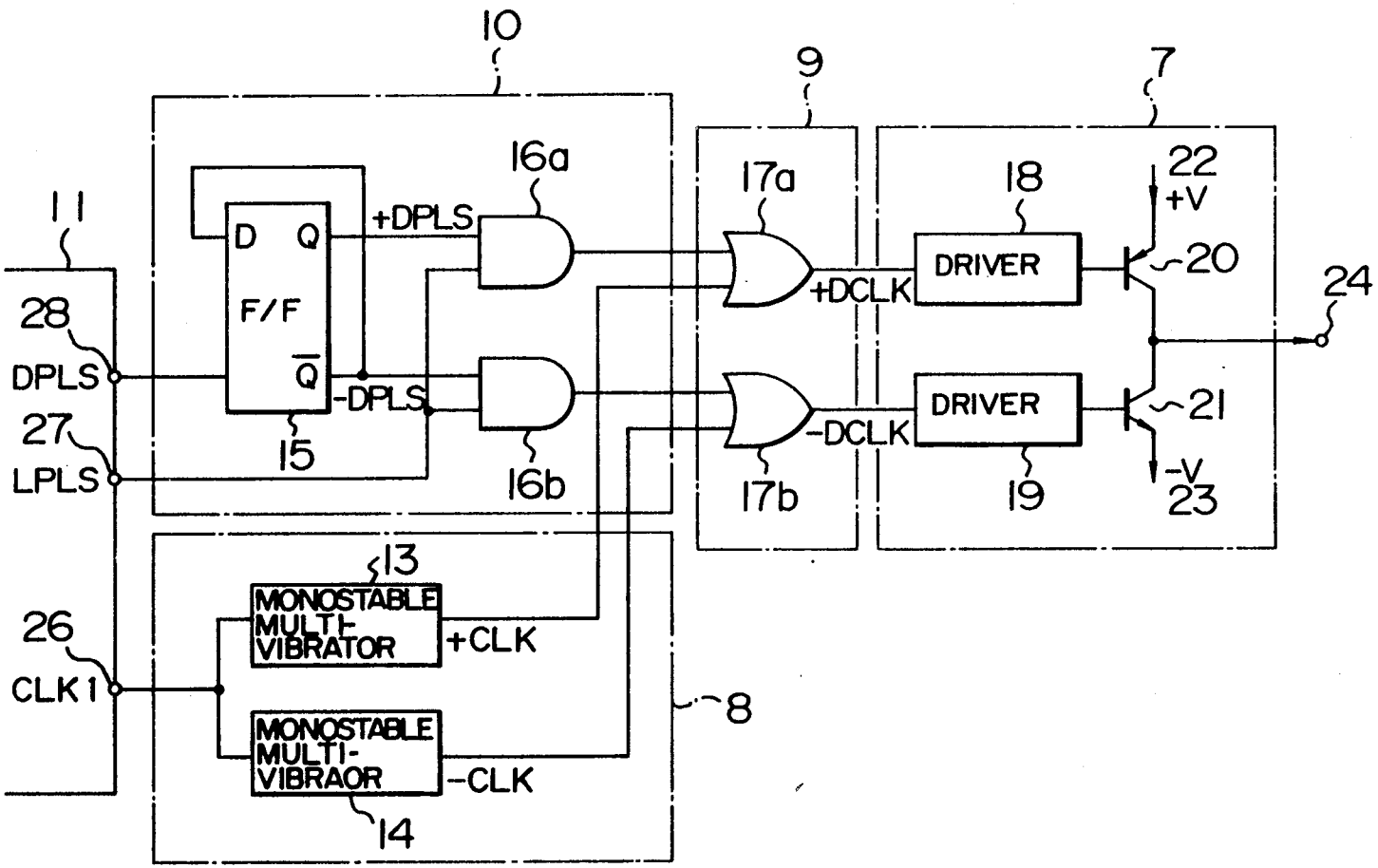
FIG. 2 is a circuit diagram of an electrode controller used in the embodiment of FIG. 1.

FIG. 2 is a circuit diagram of the voltage controller 12, in which numeral 26 denotes an output terminal for a preheating control pulse CLK1 for determining a frequency of AC current between the electrodes, 27 an output terminal for an ink jet control pulse LPLS for determining a time of applying a DC voltage to produce a conductive ink jet discharge from the nozzle 3, and 28 an output terminal for a printing pulse DPLS representing a printing timing. These pulses are produced by the control unit 11 which operates in accordance with a program represented as a flow chart described later. Numeral 13 denotes a monostable multivibrator which produces a pulse +CLK in synchronism with a rising edge of the preheating control pulse CLK1, and 14 a monostable multivibrator which produces a pulse −CLK in synchronism with a falling edge of the preheating control pulse CLK1. These monostable multivibrators 13 and 14 constitute the AC pulse generating unit. Numeral 15 denotes a flip-flop for producing outputs +DPLS and −DPLS alternately at every ink jet discharge in synchronism with a rising edge of the printing pulse DPLS, and 16*a* and 16*b* AND circuits for making logical products of the ink jet control pulse LPLS and the outputs +DPLS and −DPLS of the flip-flop 15, respectively. The flip-flop 15 and the AND circuits 16*a* and 16*b* constitute the DC pulse generating unit. Numerals 17*a* and 17*b* denote OR circuits for making logical sums of outputs +CLK and −CLK of the monostable multivibrators 13 and 14 and outputs of the AND circuits 16*a* and 16*b*, respectively, and the OR circuits constitute the signal mixing unit 9. Numerals 18 and 19 denote drivers for turning on transistors TR1 and TR2 during high level H period of outputs +DCLK and −DCLK of the OR circuit 17*a*, 17*b* numerals 20 and 21 denote transistors TR1 and TR2, respectively, for causing a current to flow through the electrode 5, and numerals 22 and 23 denote positive and negative power supplies, respectively. The drivers 18 and 19, the transistors 20 and 21 and the positive and negative power supplies 22 and 23 constitute the voltage output unit 7.

Figure 3:
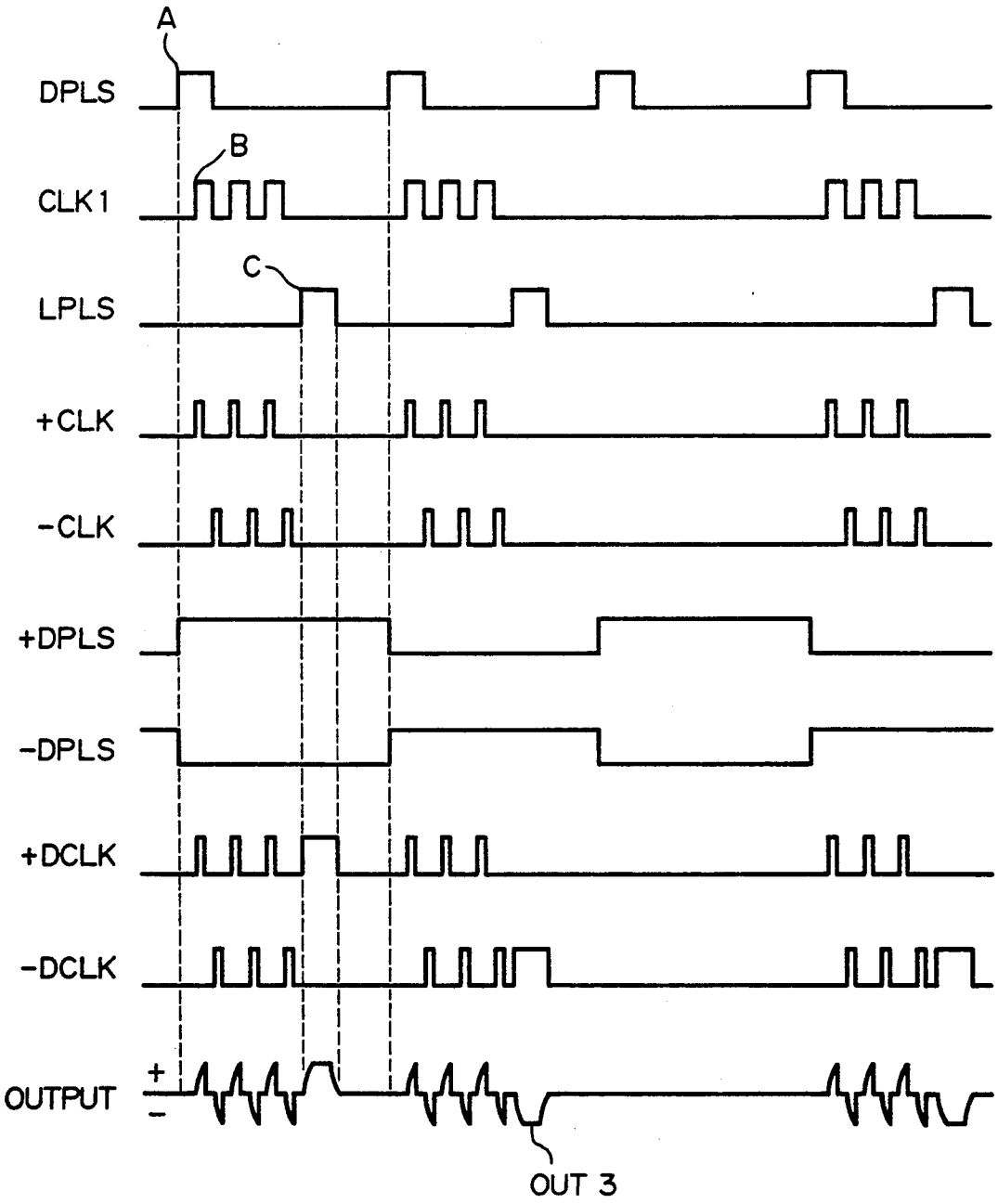
FIG. 3 is a timing chart of a voltage controller used in the FIG. 1 embodiment.

Operation of the voltage controller having the above structure is now described with reference to a timing chart of FIG. 3.

The printing pulse DPLS is first produced from the output terminal 28 at time A to reverse the output of the flip-flop 15 so that the output +DPLS of the flip-flop is produced. Thereafter, three printing control pulses CLK1 are produced from the output terminal 26 at time B. The monostable multivibrators 13 and 14 produce three output pulses +CLK and −CLK in synchronism with rising edges and falling edges of the printing control pulses, respectively. The output pulses drive the drivers 18 and 19 through the OR circuits 17*a* and 17*b* so that three pulses of an AC voltage designated by OUTPUT are produced from an output terminal 24. After the three pulses CLK1 have been produced, the ink jet control pulse LPLS is produced from the output terminal at time C and is supplied to the driver 18 by means of the AND circuits 16*a* and 16*b*. Consequently, the transistor 20 is turned on and accordingly a positive DC voltage designated by OUTPUT is produced from the output terminal 24. In the next drive, since the output of the flip-flop 15 is reversed by the pulse DPLS, a negative DC voltage is produced as indicated by OUTPUT.

Figure 4:
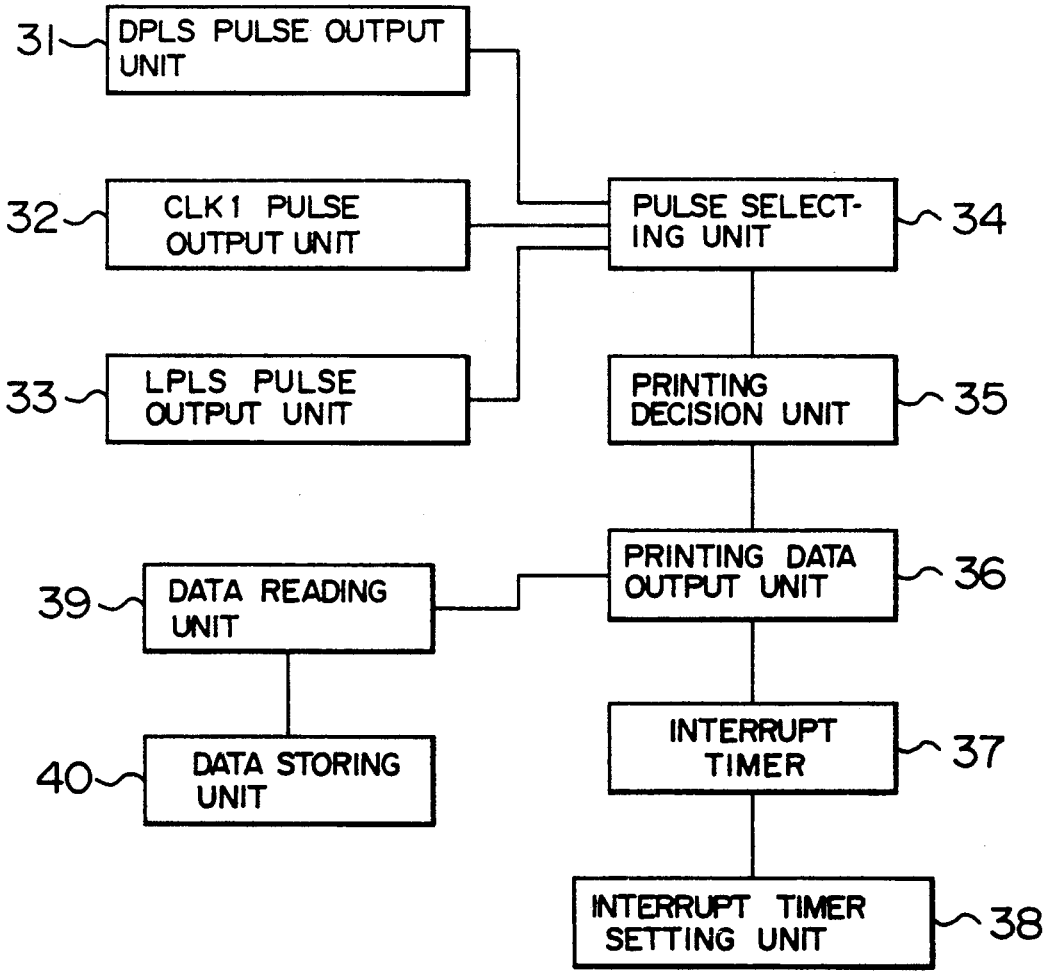
FIG. 4 is a functional block diagram of a control unit of the FIG. 1 voltage controller used in the embodiment.

FIG. 4 is a functional block diagram of the control unit 11, and its configuration is now described.

In FIG. 4, numeral 40 denotes a data storing unit, 39 a data reading unit for reading necessary data from the data storing unit, 37 an interrupt timer, 38 an interrupt timer setting unit for setting the interrupt timer, 36 a printing data output unit for receiving an output from the interrupt timer to produce the printing data read by the data reading unit, 35 a printing decision unit for deciding to spout ink out from the nozzle 3 in accordance with the data including print patterns provided from the printing data output unit 36, 34 a pulse selecting unit for determining the order of pulses in the printing, 31 a DPLS pulse output unit for producing the DPLS pulse, 32 a CLK1 pulse output unit for producing the CLK pulse, and 33 an LPLS pulse output unit for producing the LPLS pulse.

Figure 5:
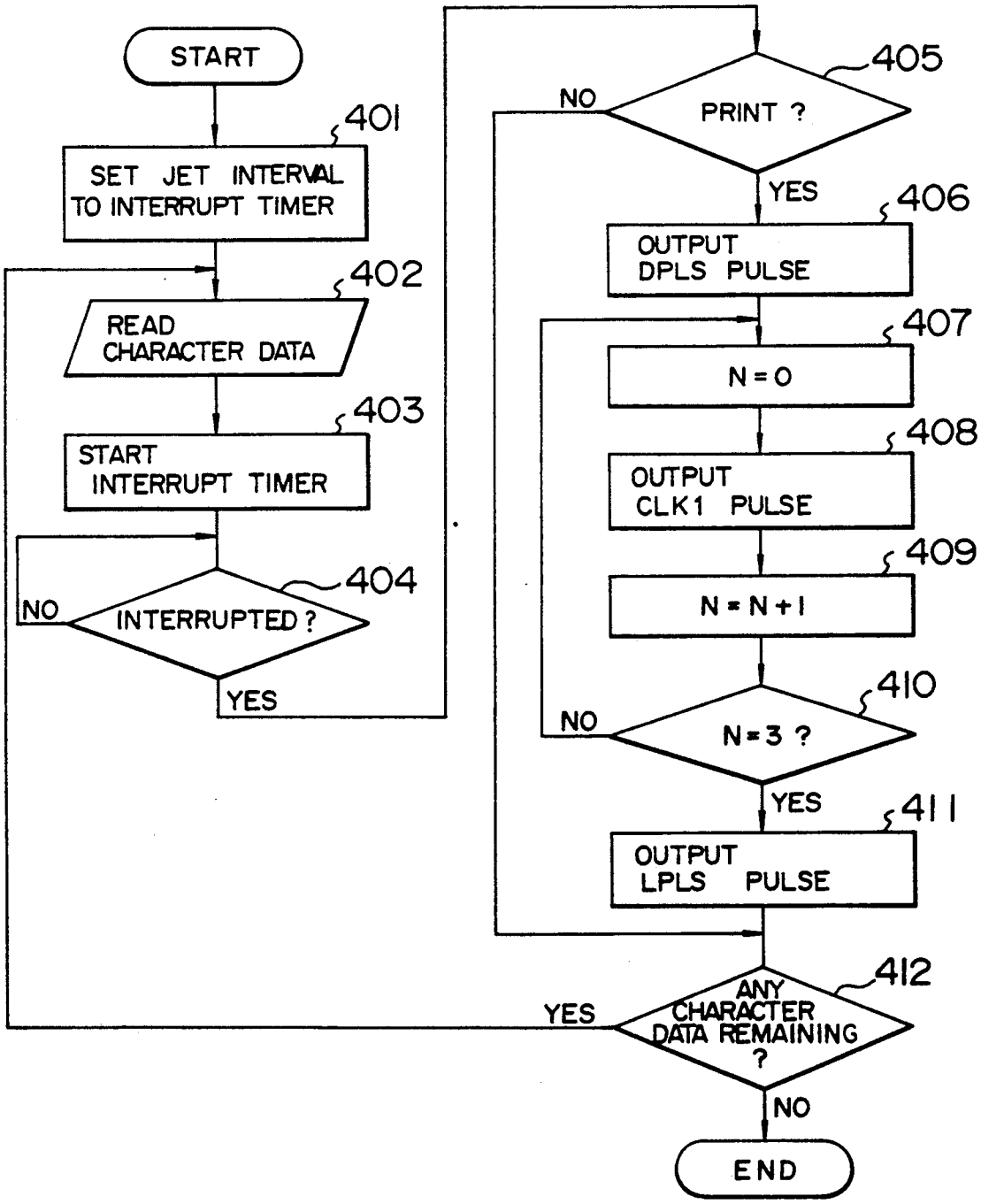
FIG. 5 is a flow chart showing the operation of the control unit of FIG. 4.
Figure 6:
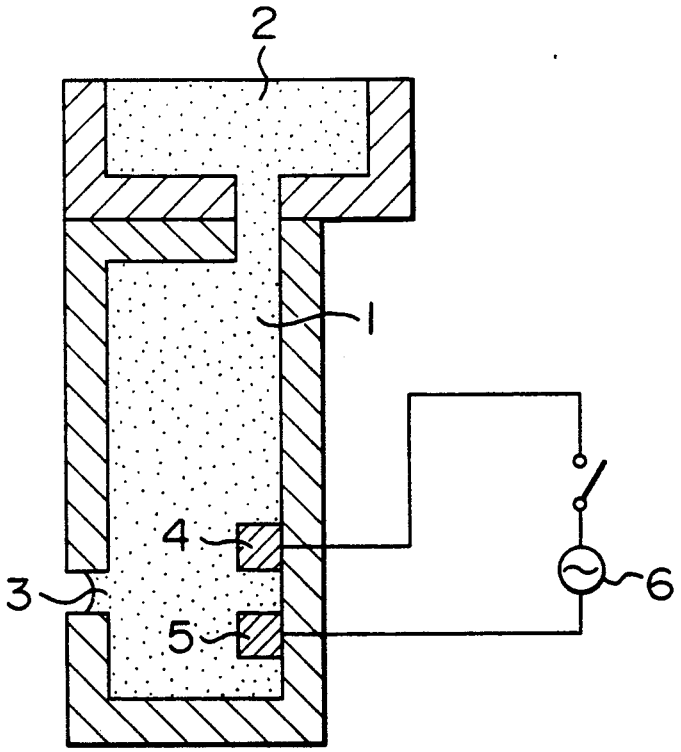
FIG. 6 PRIOR ART
FIG. 6 schematically illustrates a conventional ink jet apparatus.
Figure 7:
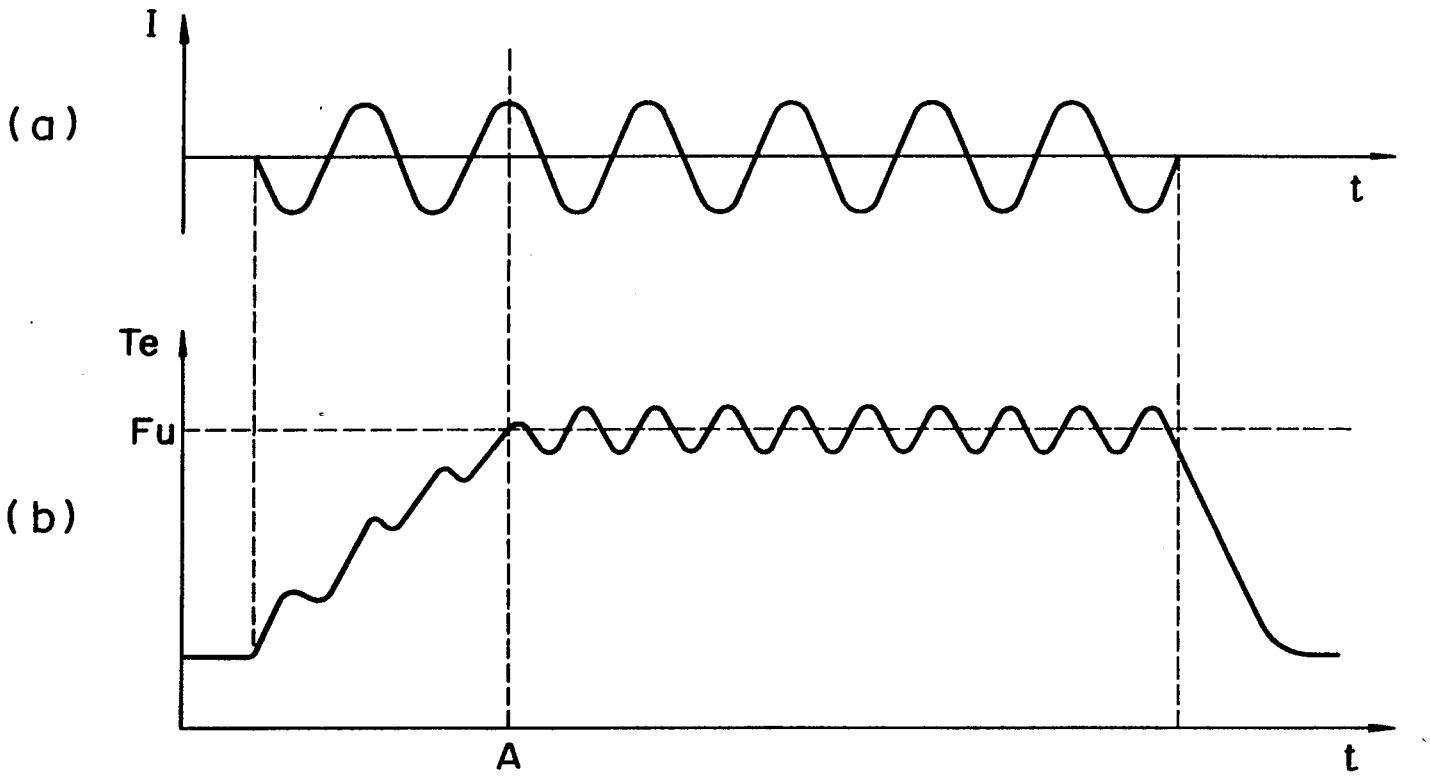
FIG. 7 PRIOR ART
FIG. 7 is the ink timing chart showing a temperature and the current flowing through the ink when an AC voltage is applied to the ink jet apparatus of FIG. 6.

Operation of the control unit 11 having the above structure above is described hereinafter, with reference to a flow chart of FIG. 5.

An interval or period of jetting ink is set to the interrupt timer (401) by the interrupt timer setting unit 38. The data reading unit 39 reads data from the data storing unit (402). Then, the interrupt timer 37 is started (403) and the process waits until an output of the interrupt timer 37 is produced (404). When an interrupt is produced, the printing data output unit 36 produces the data read by the data reading unit 39 to a printing decision unit 35. The printing decision unit 35 decides whether ink is to be jetted or not in accordance with the printing data (405). When ink is jetted, the printing decision unit 35 supplies an output to the pulse selecting unit 34. Thus, the pulse selecting unit 34 drives the DPLS pulse output unit 31, the CLK1 pulse output unit 32 and the LPLS pulse output unit 33 so that one DPLS pulse, three CLK1 pulses and one LPLS pulse are produced in order of description thereof (406–411). When the output of the printing data has been completed, the printing judgement unit (not showing FIG. 4) decides whether there is the next data or not (412), and if there remains the next data, the character data reading unit reads data from the character storing unit again and the subsequent operation is started.

In the above embodiment, with the provision of the voltage controller 12, it can be established that the AC current flows between the electrodes 4 and 5 in the rising process of temperature of the conductive ink and the DC current flows therebetween when the ink is jetted. Accordingly, the conductive ink can be jetted stably during the application of the DC voltage while preventing the electrolysis of the conductive ink by means of the AC current. Gradational print expressions can be made by adjusting the period of applying the DC voltage. Further, it has been found from experimentation that the frequency of the AC voltage is desirably equal to or higher than 100 KHz in order to prevent electrolysis effectively. In addition, it is desirable that the period of the DC voltage is around 30 μsec for the same reason.

As described above, according to the present invention, since there is provided voltage application means for applying the AC voltage between the pair of electrodes as long as the temperature of the conductive ink does not reach the boiling point thereof and applying the DC voltage therebetween thereafter, the ink can be jetted stably by means of the DC current while preventing the electrolysis of the conductive ink by means of the AC current.

We claim:

1. An ink jet apparatus comprising:

an ink reservoir for storing conductive ink, said ink reservoir having an inner wall;

a pair of electrodes mounted on the inner wall of said ink reservoir;

a nozzle having an opening disposed in fluid communication with said ink reservoir; and electrode voltage control means for supplying a controlled voltage to said electrodes, said controlled voltage including an AC voltage for preheating said ink and a DC voltage sufficient to boil the ink after it has been preheated such that said ink is evaporated to produce bubbles which are jetted from said nozzle, said voltage control means ceasing voltage application to said electrodes for a predetermined time duration after application of said DC voltage.

2. An ink jet apparatus according to claim 1, wherein said AC voltage has a frequency which is equal to or higher than 100 KHz.

3. An ink jet apparatus according to claim 1, wherein said DC voltage has an energization time of 30 μsec or less.

4. An ink jet apparatus according to claim 1, wherein said electrode voltage control means controls application of said DC voltage such that said DC voltage applied to said electrodes at alternate voltage polarities for successive ink jet discharges through said nozzle.

* * * * *